US009675945B2

(12) United States Patent
Durand et al.

(10) Patent No.: US 9,675,945 B2
(45) Date of Patent: Jun. 13, 2017

(54) DEVICE FOR THE CONTINUOUS TREATMENT OF AT LEAST ONE RAW MATERIAL, TREATMENT INSTALLATION AND USE OF SUCH A DEVICE

(75) Inventors: Daniel Durand, Bas en Basset (FR); Jerome Mottaz, Saint-Maurice de Lignon (FR); Luis Asensio, Savigneux (FR); Didier Salques, Saint Etienne (FR)

(73) Assignee: CLEXTRAL, Firminy (FR)

( * ) Notice: Subject to any disclaimer, the term of this patent is extended or adjusted under 35 U.S.C. 154(b) by 61 days.

(21) Appl. No.: 13/984,113

(22) PCT Filed: Feb. 8, 2012

(86) PCT No.: PCT/EP2012/052133
§ 371 (c)(1),
(2), (4) Date: Aug. 7, 2013

(87) PCT Pub. No.: WO2012/107491
PCT Pub. Date: Aug. 16, 2012

(65) Prior Publication Data

US 2013/0308412 A1 Nov. 21, 2013

(30) Foreign Application Priority Data

Feb. 9, 2011 (FR) ..... 11 51017

(51) Int. Cl.
*B01F 7/00* (2006.01)
*B01F 7/02* (2006.01)
(Continued)

(52) U.S. Cl.
CPC ..... *B01F 7/00975* (2013.01); *B01F 7/00116* (2013.01); *B01F 7/00158* (2013.01);
(Continued)

(58) Field of Classification Search
CPC . B01F 13/1019; B01F 3/1207; B01F 7/00975
(Continued)

(56) References Cited

U.S. PATENT DOCUMENTS 1,603,546 A * 10/1926 Kirschbraun ..... B01F 7/06 366/145
2,177,910 A * 10/1939 Smit ..... B01F 7/047 366/156.1
(Continued)

FOREIGN PATENT DOCUMENTS

DE 22 43 083 3/1974
EP 0264069 4/1988
(Continued)

OTHER PUBLICATIONS

International Search Report dated Apr. 17, 2012; corresponding to PCT/EP2012/052133.

*Primary Examiner* — Tony G Soohoo
*Assistant Examiner* — Elizabeth Insler
(74) *Attorney, Agent, or Firm* — Young & Thompson

(57) ABSTRACT

The continuous treatment device (10) includes a tank (11) of elongated shape and that determines a mixing chamber (15) which includes, at a first end, at least one inlet orifice (12) for the raw material and, at a second end, at least one outlet orifice (13) for the treated material, and also, between these orifices, at least one agitator shaft (16) equipped with blades (17) suitable for continuously mixing and advancing the material in the mixing chamber (15) from the inlet orifice to the outlet orifice. The device also includes a mixing screw (25) in the bottom of the tank, which is positioned in the mixing chamber (15), below and parallel to the at least one shaft (16), and which is suitable for being rotated, about at
(Continued)

least one direction of rotation, the opposite way from the advance of the material from the inlet orifice to the outlet orifice.

15 Claims, 1 Drawing Sheet

(51) Int. Cl.

| | |
|---|---|
| ***B01F 7/04*** | (2006.01) |
| ***B01F 7/08*** | (2006.01) |
| ***B01F 13/10*** | (2006.01) |
| ***B01F 15/02*** | (2006.01) |
| *B01F 3/06* | (2006.01) |
| *B01F 3/12* | (2006.01) |

(52) U.S. Cl.
CPC ..... *B01F 7/00208* (2013.01); *B01F 7/00633* (2013.01); *B01F 7/022* (2013.01); *B01F 7/042* (2013.01); *B01F 7/087* (2013.01); *B01F 13/1038* (2013.01); *B01F 15/027* (2013.01); *B01F 3/06* (2013.01); *B01F 3/12* (2013.01)

(58) Field of Classification Search
USPC ..... 366/133, 290, 292, 297, 325.4, 603, 366/158.4
See application file for complete search history.

(56) References Cited

U.S. PATENT DOCUMENTS

| | | | | | |
|---|---|---|---|---|---|
| 3,215,408 | A | * | 11/1965 | Hansen | B01F 13/0035 366/158.2 |
| 3,403,824 | A | | 10/1968 | Biehl | |
| 3,468,519 | A | * | 9/1969 | Lorenzen | A01K 5/0258 119/57.1 |
| 3,672,640 | A | | 6/1972 | Crose | |
| 3,687,422 | A | | 8/1972 | List | |
| 3,689,035 | A | | 9/1972 | List | |
| 4,483,625 | A | * | 11/1984 | Fisher | B01F 7/022 366/196 |
| 4,493,557 | A | * | 1/1985 | Nayak | C03B 5/1875 366/297 |
| 4,707,140 | A | * | 11/1987 | Mohrlang | 366/186 |
| 4,752,139 | A | | 6/1988 | Hauck | |
| 4,896,970 | A | | 1/1990 | Schuler | |
| 4,938,605 | A | * | 7/1990 | Friedrich | B29B 7/7476 366/149 |
| 5,505,540 | A | | 4/1996 | Froslund | |
| 6,923,393 | B1 | * | 8/2005 | Neier et al. | 241/30 |

FOREIGN PATENT DOCUMENTS

| | | |
|---|---|---|
| FR | 1271333 | 9/1961 |
| FR | 2 483 251 | 12/1981 |
| WO | 9706892 | 2/1997 |
| WO | 2011/027556 | 3/2011 |

* cited by examiner

DEVICE FOR THE CONTINUOUS TREATMENT OF AT LEAST ONE RAW MATERIAL, TREATMENT INSTALLATION AND USE OF SUCH A DEVICE

BACKGROUND OF THE INVENTION

Field of the Invention

The present invention relates to a device for the continuous treatment of at least one food or non-food raw material, and more particularly the treatment of solid-liquid mixtures, for example such as particulate and/or powdery mediums with aqueous or organic mediums, or solid-gas mixtures, as well as solid-liquid-gas mixtures.

The solids are for example particles, grains, flakes, flours or others, as well as fragmented lignocellulose products for temperature-controlled mixing and impregnation.

The treatment of this type of raw material for example consists of mixing and/or preheating, and/or hydration, and/or precooking and/or cooking of the raw material.

This type of treatment is for example done in a device having an elongated vat, with a single or double wall and which may or may not be pressurized. This vat defines a mixing chamber comprising at least one inlet orifice for the raw material and at least one outlet orifice for the treated material at the opposite ends of the vat, respectively.

DESCRIPTION OF THE RELATED ART

In the mixing chamber, the vat contains, between the inlet orifice and the outlet orifice, one or two parallel shafts provided with generally separated blades that can be inclined. These blades are designed to agitate the raw material and, due to their incline, to perform the mixing and cause the material to progress from the inlet orifice toward the outlet orifice. The vat may include orifices or injectors for a liquid, the liquid for example being water or oil or any other liquid, or for steam designed to heat and moisten the raw material. EP-A-0,264,069 provides an example of such a treatment vat.

Generally, the intensity of the mixing and the filling level in the vat are adjusted by inclining the moving blades in the mixing chamber and by the speed of rotation of the shafts. The orientation of the blades may be positive if, by rotating them, they tend to advance the material from the inlet orifice toward the outlet orifice, and the orientation of said blades may be negative if, on the contrary, the blades tend to slow the progression of the material inside the mixing chamber. The greater the number of blades oriented negatively, i.e., opposing the progression of the material toward the outlet orifice, the greater the mixing intensity and the filling level in the mixing chamber, which most often do not exceed 40% to 60% of the volume of the vat.

This poor filling level causes a poor exchange between the steam, the liquids and the raw material, such that the output of the device is not excellent.

The effectiveness of the treatment device is adjusted by mechanically modifying the orientation of the blades of the shafts. This blade-by-blade adjustment is a lengthy and tedious operation relying on the operator's know-how, and requires that the device be stopped and completely cleaned, thereby leading to significant production losses each time an adjustment is necessary. The compromise of the orientation of the blades in the negative direction and in the positive direction to ensure sufficient treatment of the raw material does not allow quick and effective auto-emptying of the device and requires a major manual cleaning operation each time the formulation or production is changed.

BRIEF SUMMARY OF THE INVENTION

The invention aims to propose a device for continuously pretreating a raw material that avoids these drawbacks and makes it possible to improve output.

The invention therefore relates to a device for continuously treating a raw material made up of solid-liquid or solid-gas or solid-liquid-gas mixtures.

Other features of the device according to the invention are specified in dependent claims.

The invention also relates to a treatment installation, as defined in below.

The invention further relates to uses of the aforementioned treatment device, as defined below.

BRIEF DESCRIPTION OF THE DRAWINGS

Other features and advantages of the invention will emerge from the detailed description thereof provided below, for information and non-limitingly, in reference to the appended figures, in which.

DETAILED DESCRIPTION OF THE PREFERRED EMBODIMENTS

Figure 2:
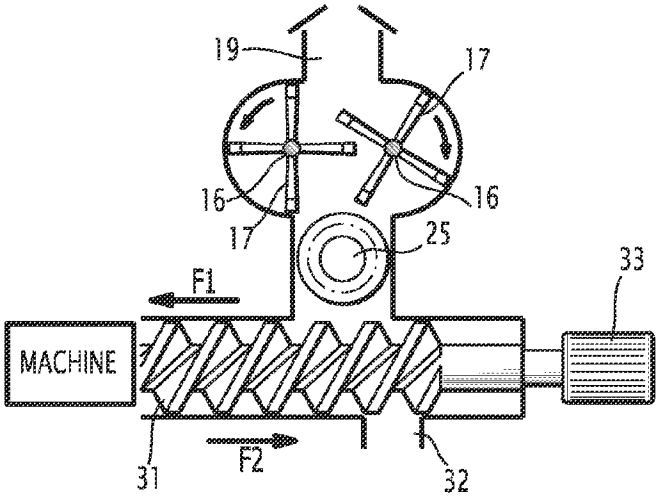
FIG. 2 is a diagrammatic transverse cross-sectional view along line II-II of FIG. 1.
Figure 1:
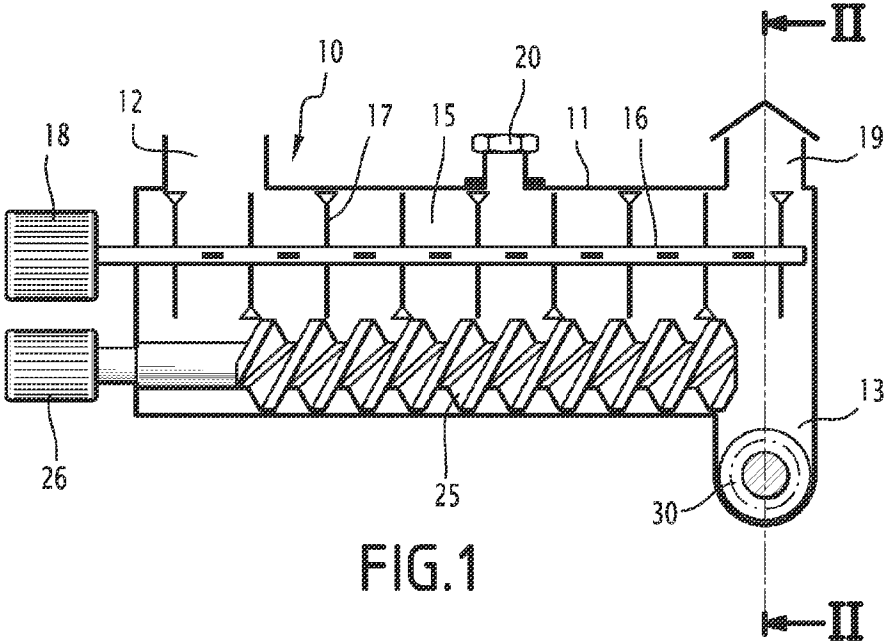
FIG. 1 is a diagrammatic longitudinal cross-sectional view of a treatment device, according to the invention.

FIGS. 1 and 2 show a device 10 for the continuous treatment of a raw material made up of a first food or non-food material, and for example solid-liquid mixtures, solid-gas mixtures or solid-liquid-gas mixtures. Advantageously, the device 10 may be used more generally to continuously treat and/or condition at least one mixture of products in two different states from among the solid, liquid and gas states.

The device 10 comprises an elongated vat 11 defining a mixing chamber 15 including at least one inlet orifice 12 for the raw material at a first end and an outlet orifice 13 for the treated material at the other end. Thus, during use, material inserted into the mixing chamber 15 through the inlet orifice 12 travels through the mixing chamber from one of its ends to its opposite end along the vat, from where it exits the mixing chamber through the outlet orifice 13.

Between the inlet 12 and outlet 13 orifices, respectively, the mixing chamber 15 of the vat 11 contains at least one agitating shaft 16 provided with blades 17. As explained in more detail hereafter, the blades 17 of the shaft(s) 16 make it possible to agitate the raw material so as to mix it continuously while causing it to progress from the inlet orifice 12 toward the outlet orifice 13.

In the example embodiment shown in FIGS. 1 and 2, the mixing chamber 15 comprises two parallel agitating shafts 16 each provided with blades 17. Each shaft 16 is driven by an electric motor 18 placed outside the vat 11. In that case, the vat 11 is made up of a tube in the shape of a figure eight, as shown in FIG. 2. Advantageously, the two shafts 16 are provided to perform dispersive axial mixing of the material between the inlet orifice 12 and the outlet orifice 13: in that case, as indicated in FIG. 2, the shafts 16 are, during use, driven in respective directions of rotation that are opposite one another and at least some of their respective blades 17 have a radial dimension strictly larger than half the distance separating the shafts 16, in other words half of their center-to-center spread. In this way, the material situated more or less midway between the shafts 16 is agitated both by the blades 17 of one of the shafts in a direction peripheral to that shaft, and by the blades 17 of the other shaft in a direction peripheral thereto, in the opposite direction.

In the event the vat 11 contains a single shaft 16, that vat is in the shape of a simple tube.

The vat 11 includes a single or double wall and the vat 11 may or may not be pressurized.

Figure 3:
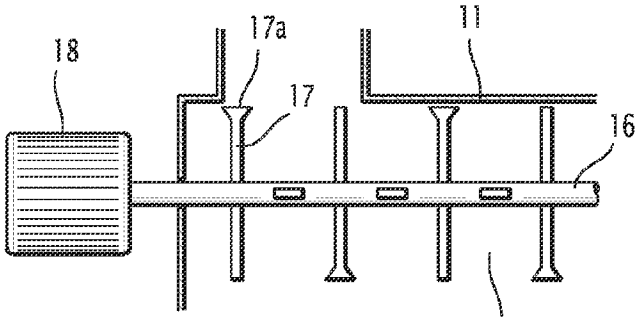
FIG. 3 is a diagrammatic view of the blades of the shaft of the treatment device, according to the invention.

As shown in FIG. 3, the blades 17 include an end 17*a* in the shape of a triangle and the positioning of those blades 17 is done so as to have a surface overlap allowing good dispersive mixing and auto-scraping of the wall of the vat 11.

As shown in FIG. 1, the vat 11 includes a vent 19 and at least one liquid injection orifice 20, for example for water, oil or any other liquid and/or gas, for example such as steam, designed to heat and moisten the raw material.

The treatment device 10 also includes a mixing screw 25 for the bottom of the vat, in other words arranged in the mixing chamber 15, at the bottom thereof, as shown in FIGS. 1 and 2. This mixing screw 25 is rotated by an electric motor 26 positioned outside the vat 11. The mixing screw 25 is provided to be rotated at least opposite the progression of the material from the inlet orifice 12 toward the outlet orifice 13 and, preferably, in both directions of rotation. This mixing screw 25 is positioned below and parallel to the shafts 16 and extends substantially between the inlet 12 and outlet 13 orifices.

In the example embodiment shown in the figures, the treatment device 10 also includes a complementary screw 30 with two directions of rotation positioned below the outlet orifice 13 of the vat 11 extending perpendicular to the mixing screw 25. The complementary screw 30 is positioned in a sheath 31 that includes, substantially below the outlet orifice 13 of the vat 11, an emptying valve 32 that may be opened or closed, as will be seen later.

In the event the device 10 is used as a pretreatment device, the complementary screw 30 makes it possible to transfer the pretreated material from the outlet orifice 13 of the vat 11 toward a subsequent treatment machine, not shown. This complementary screw 30 is rotated in both directions by an electric motor 33 (FIG. 2).

This subsequent treatment machine is formed by an extrusion machine with one or more screws by a cooker or a reactor or by any other suitable machine.

The raw material is introduced through the inlet orifice 12 inside the vat 11, and that raw material is mixed with the various ingredients introduced into the mixing chamber 15, by the blades 17 rotated by the shafts 16. The raw material, during mixing thereof, progressively advances toward the outlet orifice 13.

In the so-called normal operating configuration, the mixing screw 25 is rotated by the motor 26 to push the raw material toward the upstream direction of the treatment device 10, i.e., toward the inlet orifice 12, in the direction opposite the progression of that raw material from the inlet orifice 12 toward the outlet orifice 13.

Driving the mixing screw 25 in the opposite direction makes it possible to adjust the treatment of the raw material more effectively and flexibly depending on the raw materials to be treated. The action of this mixing screw 25, which slows the flow of the raw material due to its countercurrent effect and based on its speed of rotation, and through turbulence makes it possible to increase the filling level in the vat 11 and thus to regulate the residence time of the raw material in the mixing chamber 15 of the vat 11. This regulated action of the residence time of the material in the mixing chamber 15 is particularly remarkable in the case where, in the presence of two shafts 16 provided to perform dispersive axial mixing of the material, the mixing screw 25 is situated substantially midway between these two shafts, as shown in FIG. 2: in that case, the mixing screw 25 makes it possible to combine the dispersive axial mixing, which homogenizes the material in time and space, with radial mixing, which limits or even makes negligible the deviations in residence time of the material in the mixing chamber 15.

This greater mixing flexibility and effectiveness of the treatment device associated with an improved filling level of the mixing chamber 15, greater than 50%, or even strictly greater than 60%, contributes to reducing losses and obtaining more or less homogenous hydration of the particles of the raw material to be treated, and therefore better energy output of the pretreatment device.

The mixing screw 25 constitutes an additional adjustment means that is accessible without stopping the treatment device, which is obtained by acting on the speed of said mixing screw 25, thereby making it possible to adjust the operating parameters without losing time or raw material. Consequently, the adjustment of the incline of the blades 17 of each shaft 16 is no longer an essential adjusting element and no longer needs to be modified for each treated material.

In the so-called emptying configuration, the vat 11 of the treatment device 10 is optionally connected to a cleaning system (not shown), and the mixing screw 25 is driven in an opposite direction of rotation such that said mixing screw 25 pushes the material from the inlet orifice 12 toward the outlet orifice 13 of the vat 11. This arrangement makes it possible to evacuate the material contained in the treatment device 10 easily, which saves time when cleaning the vat.

In the so-called normal operating configuration, the complementary screw 30 is rotated by the motor 33 in the positive direction so as to transfer the pretreated material between the outlet orifice 13 of the vat 11 toward the extrusion machine in the direction indicated by the arrow F1 in FIG. 2, the emptying valve 32 being in the closed position.

In the so-called emptying configuration, the complementary screw 30 is rotated in the negative direction so as to evacuate, in the direction of the arrow F2, the solid or liquid residue contained in the vat 11, the emptying valve 32 being in the open position.

In the situation for changing material to be pretreated without performing intermediate cleaning of the vat, the complete emptying of said vat using the screw 25 reduces the risk of cross-contamination.

Lastly, the device may be coupled with an automated cleaning system to improve the production and hygiene conditions, in particular during the phases for changing material and/or stopped phases.

The invention claimed is:

1. A device for continuously treating at least one raw material made up of solid-liquid or solid-gas or solid-liquid-gas mixtures, the device comprising:

an elongated vat defining a mixing chamber that extends continuously in a longitudinal direction, the elongated vat extending in the longitudinal direction from a first end to an opposite, second end, the mixing chamber including i) at least one inlet orifice which is located at the first end of the vat and through which the raw material enters into the mixing chamber, and ii) at least one outlet orifice which is located at the second end of the vat and through which the material entered into the mixing chamber through the inlet orifice exits from the mixing chamber;

at least one agitating shaft extending in the longitudinal direction in the mixing chamber between said inlet and outlet orifices, the at least one agitating shaft being provided with blades and including an end part that is located in vertical alignment above the outlet orifice, a discharge passage being below the end part of the at least one agitating shaft and being above the outlet orifice;

a mixing screw being positioned in the mixing chamber below and parallel to said at least one agitating shaft, the mixing screw including an active part that extends in the longitudinal direction in the mixing chamber between said inlet and outlet orifices and that is arranged along a bottom wall of the vat, the bottom wall extending in the longitudinal direction between said inlet and outlet orifices and having a discharge end which is located at the second end of the vat and at which the bottom wall emerges into the discharge passage; and a drive mechanism operatively connected to each of the at least one agitating shaft and the mixing screw and arranged to rotate each of the at least one agitating shaft and the mixing screw;

wherein the blades of the at least one agitating shaft both mix the material and continuously progress the material in the longitudinal direction from the inlet orifice toward the outlet orifice when the at least one agitating shaft is rotated by the drive mechanism, wherein the active part of the mixing screw mixes the material in a bottom region of the mixing chamber when the mixing screw is rotated by the drive mechanism, wherein an overall length of the at least one agitating shaft is greater than an overall length of the active part of the mixing screw so that at the second end of the vat, the active part of the mixing screw terminates at the discharge passage so that the active part of the mixing screw does not extend into the discharge passage while being in free communication with the discharge passage in the longitudinal direction at the discharge end of the bottom wall, wherein the active part of the mixing screw is in free fluid communication vertically with the at least one agitating shaft through a flow passage that is provided in the mixing chamber along both the at least one agitating shaft and the active part of the mixing screw and that is located vertically below the at least one agitating shaft and vertically above the active part of the mixing screw, wherein in a normal mixing operating configuration:

the drive mechanism rotates said at least one agitating shaft so as to drive the material entered into the mixing chamber through the inlet orifice from the inlet orifice to the end part of the at least one agitating shaft, the material entered into the mixing chamber through the inlet orifice and driven to the end part of the at least one agitating shaft falls downwardly from the end part of the at least agitating shaft into the outlet orifice through the discharge passage, and the drive mechanism rotates the mixing screw in a first direction of rotation so that the active part of the mixing screw opposes the material that the at least agitating shaft progresses from the inlet orifice toward the outlet orifice, by pushing in the longitudinal direction away from the discharge passage the material having fallen downwardly from the at least one agitating shaft into the bottom region of the mixing chamber through the flow passage, and wherein in an emptying configuration, the drive mechanism rotates the mixing screw in a second direction of rotation, that is opposite the first direction, so that the active part of the mixing screw drives the material in the mixing chamber in a direction towards the outlet orifice, by pushing in the longitudinal direction along the bottom wall the material having fallen downwardly from the at least one agitating shaft into the bottom region of the mixing chamber through the flow passage, until the material of the bottom region of the mixing chamber enters the discharge passage at the discharge end of the bottom wall.

2. The device according to claim 1, wherein the mixing screw extends between the inlet orifice and the outlet orifice.

3. The device according to claim 1, wherein the device includes, below the outlet orifice, a complementary screw with two directions of rotation extending perpendicular to the mixing screw, the complementary screw transferring the treated material from the outlet orifice.

4. The device according to claim 1, wherein two parallel agitating shafts are provided.

5. The device according to claim 4, wherein said drive mechanism is arranged to rotate the two parallel agitating shafts in respective directions of rotation that are opposite one another and wherein at least some of the respective blades of the two parallel agitating shafts have a radial dimension strictly larger than half of their center-to-center spread.

6. The device according to claim 4, wherein the mixing screw is substantially equidistant from the two parallel agitating shafts.

7. The device according to claim 1, wherein said drive mechanism comprises both a first motor driving said at least one agitating shaft, the first motor positioned outside the vat, and a second motor driving the mixing screw, the second motor also positioned outside the vat.

8. The device according to claim 1, wherein the active part of the mixing screw is threaded.

9. The device according to claim 1, wherein the flow passage extends continuously in the longitudinal direction along the active part of the mixing screw, the flow passage not extending into the discharge passage.

10. An installation for treating at least one raw material made up of solid-liquid or solid-gas or solid-liquid-gas mixtures, wherein the installation includes a device for continuously treating the raw material, according to claim 1, and the installation further includes a subsequent treatment machine, supplied with material leaving the outlet orifice of the treatment device.

11. The installation according to claim 10, wherein the subsequent treatment machine includes an extrusion machine with one or more screws.

12. A method of continuously treating at least one raw material made up of solid-liquid or solid-gas or solid-liquid-gas mixtures, comprising using the device of claim 1 to execute each of:

a pretreating step for pretreating said at least one raw material, said pretreating step including both operating said at least one agitating shaft to provide the continuous progression of the material from the inlet orifice toward the outlet orifice and operating the mixing screw to mix the bottom region of the vat, by rotating the mixing screw in the first direction of rotation, opposite the continuous progression of the material from the inlet orifice toward the outlet orifice; and a transferring step for providing the pretreated at least one raw material from outlet orifice to a subsequent treatment machine.

13. The method according to claim 12, wherein the subsequent treatment machine includes an extrusion machine with one or more screws.

14. The method according to claim 12, wherein the pretreating step includes filling the mixing chamber at a filling rate strictly greater than 60%.

15. A method to continuously treat or condition a mixture of products in two different states from among the solid, liquid and gas states, comprising using the device of claim 1 to execute each of:

a pretreating step for pretreating said at least one mixture, said pretreating step including both operating said at least one agitating shaft to provide the continuous progression of the mixture from the inlet orifice toward the outlet orifice and operating the mixing screw to mix the bottom region of the vat, by rotating the mixing screw in the first direction of rotation, opposite the continuous progression of the mixture from the inlet orifice toward the outlet orifice; and a transferring step for providing the pretreated mixture from outlet orifice to a subsequent treatment machine.

* * * * *